US009272326B2

(12) United States Patent
Werner et al.

(10) Patent No.: US 9,272,326 B2
(45) Date of Patent: Mar. 1, 2016

(54) APPARATUS FOR VENTILATION OF A CASTING MOLD

(71) Applicant: KSM Castings Group GmbH, Hildesheim (DE)

(72) Inventors: Michael Werner, Hildesheim (DE); Wolfgang-Michael Schirm, Holle (DE)

(73) Assignee: KSM Castings Group GmbH, Hildesheim (DE)

( * ) Notice: Subject to any disclaimer, the term of this patent is extended or adjusted under 35 U.S.C. 154(b) by 0 days.

(21) Appl. No.: 14/146,147

(22) Filed: Jan. 2, 2014

(65) Prior Publication Data

US 2014/0196864 A1 Jul. 17, 2014

(30) Foreign Application Priority Data

Jan. 16, 2013 (DE) ..... 10 2013 100 442

(51) Int. Cl.
*B22C 9/06* (2006.01)
*B22D 17/14* (2006.01)

(52) U.S. Cl.
CPC ..... *B22C 9/067* (2013.01); *B22D 17/145* (2013.01)

(58) Field of Classification Search
CPC ..... B22C 9/067; B22D 17/145
USPC ..... 164/305, 410
See application file for complete search history.

(56) References Cited

U.S. PATENT DOCUMENTS

| | | | | |
|---|---|---|---|---|
| 5,913,356 | A * | 6/1999 | Muramatsu | 164/305 |
| 6,425,433 | B1 * | 7/2002 | Hayes | 164/305 |
| 6,513,569 | B1 * | 2/2003 | Li et al. | 164/305 |
| 7,134,637 | B2 * | 11/2006 | Dubay | 249/141 |
| 7,631,851 | B2 * | 12/2009 | Dubay | 249/141 |
| 7,770,627 | B2 * | 8/2010 | Wang et al. | 164/305 |
| 8,424,587 | B1 * | 4/2013 | Dubay | 164/305 |

FOREIGN PATENT DOCUMENTS

| | | |
|---|---|---|
| DE | 202 08 464 U1 | 11/2002 |
| DE | 20 2010 006 751 U1 | 8/2010 |

* cited by examiner

*Primary Examiner* — Kevin P Kerns
(74) *Attorney, Agent, or Firm* — Collard & Roe, P.C.

(57) ABSTRACT

An apparatus for ventilation of a casting mold has two mold halves that lie opposite one another and are complementary, in terms of shape and function, to one another. The halves have a plurality of elevations and/or depressions, in each instance, which run essentially parallel to one another and essentially transverse to a flow direction, on their surfaces that face one another, in such a manner that when the mold halves are set onto one another, a gap having an inlet and an outlet forms between the mold halves, at least in part. The gap is washboard-shaped, labyrinth-shaped and/or meander-shaped. Through the gap, air displaced out of the casting mold and excess molten material flow during filling of the casting mold. At least one mold half is formed by multiple segments disposed next to one another in the longitudinal direction of the mold half and releasably attached.

8 Claims, 5 Drawing Sheets

APPARATUS FOR VENTILATION OF A CASTING MOLD

CROSS REFERENCE TO RELATED APPLICATIONS

Applicant claims priority under 35 U.S.C. §119 of German Application No. 10 2013 100 442.3 filed on Jan. 16, 2013, the disclosure of which is incorporated by reference.

BACKGROUND OF THE INVENTION

1. Field of the Invention

The invention relates to an apparatus for ventilation of a casting mold.

2. Description of the Related Art

When filling a casting mold, for example during high-pressure or low-pressure casting, during chill casting or some other casting method, the air situated in the casting mold has to be removed from the casting mold in order to achieve a clean casting result without cavities and porosities. This can either be done actively, by means of evacuation of the mold before the actual filling process, passively by means of displacement of the air during introduction of the casting material, or by means of a combination of these two methods.

Apparatuses for ventilation of a casting mold in the form of what are called chill vents are known from DE 202 08 464 U1 or DE 20 2010 006 751 U1. With these valve devices, ventilation of the mold takes place by means of a washboard-shaped, labyrinth-shaped or meander-shaped gap in a block-like valve body made from a highly conductive material, whereby after removal of the air from the casting mold, casting material from the casting mold enters into the gap in the valve body and solidifies there. In this way, it is ensured that all the air is removed from the mold and a satisfactory casting result is achieved.

Because of the high flow velocity of the casting material in the valve body, increased wear of the valve body occurs in the inflow region. It is known to configure the valve body with wear-resistant material in the inflow region, but such wear-resistant materials are relatively expensive.

SUMMARY OF THE INVENTION

Proceeding from this state of the art, the invention is therefore based on the task of alternatively configuring an apparatus for ventilation of a casting mold, in such a manner that wear in the inflow region can be counteracted in more cost-advantageous manner. Furthermore, the invention is based on the task of optimizing an apparatus for ventilation of a casting mold, in order to thereby be able to produce cast parts, particularly die-cast parts, preferably made of aluminum and magnesium alloys, which parts meet the highest quality demands. A further task of the invention consists in further developing an apparatus for ventilation of a casting mold in such a manner that further ventilation is not prevented by premature solidification of material in the ventilation channels. A further task of the invention consists in making an apparatus for ventilation of a casting mold available that makes do even without a cooling device and an ejector, is also easy to handle, and causes comparatively few maintenance costs.

This task is accomplished by an apparatus for ventilation of a casting mold in accordance with one aspect of the invention. Advantageous embodiments and further developments of the invention are evident from other aspects of the invention.

Proceeding from an apparatus for ventilation of a casting mold, particularly in the form of a chill vent, having two mold halves that lie opposite one another and are complementary, in terms of shape and function, to one another, which halves have a plurality of elevations and/or depressions, in each instance, which run essentially parallel to one another and essentially transverse to the flow direction, on their surfaces that face one another, in such a manner that when the mold halves are set onto one another, a gap having an inlet and an outlet forms between the mold halves, at least in part, which gap is particularly washboard-shaped, labyrinth-shaped and/or meander-shaped, and through which gap air displaced out of the casting mold and excess molten material can flow during filling of the casting mold, the invention is characterized in that at least one or preferably each mold half is formed by multiple segments disposed next to one another in the longitudinal direction of the mold half and releasably attached, preferably connected with one another.

By means of the segmentation, it is possible to use the most cost-advantageous materials and to replace the segments when needed, in other words when a segment has reached a wear limit. This is very cost-advantageous, because the mold halves no longer have to be replaced completely, but rather the segments are replaced individually. In this connection, the method of procedure can be such that a segment, particularly the first worn segment in the inflow region, is replaced with a new segment. However, it can also be advantageous if the segment adjacent to the worn segment, which is less worn, replaces it, and the segment previously adjacent to the less worn segment, which is even less worn, takes the place of the less worn segment, etc., until ultimately, the new segment takes the place of the least worn segment.

It can be advantageous if the segments of the mold half, which are disposed next to one another, have at least one bore for accommodation of an attachment part, in each instance. In this way, the segments can be fixed in place at a desired location within the casting mold.

It can be practical if at least one, preferably two bores that are spaced apart from one another and continuous in the longitudinal direction are provided per segment, whereby each bore that is continuous in the longitudinal direction aligns with a bore of a segment disposed adjacent to it, in such a manner that the segments can be connected with one another, particularly screwed together, by attachment means passed through the aligned bores. Furthermore, the mold half can be advantageously attached in the casting mold by the attachment means. The said attachment possibility particularly ensures that the individual segments disposed next to one another are connected very tightly with one another or one with the other, so that no gaps form between them, into which gaps liquid metal could flow, in disadvantageous manner.

It can be advantageous if at least one, preferably multiple bores for attachment means, which are spaced apart from one another and introduced from the outside, on one side, in the transverse direction, are provided per segment, by means of which bores each segment can be connected with a base body, particularly the casting mold, particularly screwed onto it, preferably in such a manner that the segments are releasably disposed next to one another in the longitudinal direction of the mold half. This attachment possibility facilitates the replaceability of individual segments.

It can be advantageous if the segments of the mold half can be releasably connected with one another with shape fit and/or force fit.

It can be advantageous if the segments of a mold half consist of the same material, preferably of cost-advantageous steel.

It can be advantageous if at least two segments of a mold half consist of a different material, preferably of steel, copper, tungsten or a molybdenum alloy.

It can be advantageous if at least two segments of the mold half are configured with an identical shape, as a result of which fewer different types of segments must be kept on hand, and the production as well as storage costs can be reduced.

It can be advantageous if the bores that align with one another can be used as a coolant line, particularly for air or water.

The invention also relates, not only as a further development but likewise independently, to an apparatus for ventilation of a casting mold, particularly in the form of a chill vent, having two mold halves that lie opposite one another and are complementary, in terms of shape and function, to one another, which halves have a plurality of steps, in each instance, which run essentially parallel to one another and essentially transverse to the flow direction, on their surfaces that face one another, in such a manner that when the mold halves are set onto one another, the steps of one mold half form a stair-shaped gap having an inlet and an outlet with the steps of the second mold half, through which gap air displaced out of the casting mold and excess molten material can flow during filling of the casting mold.

By means of the stair-shaped gap according to the invention and the accompanying flow-optimized geometry, air and melt must overcome a height difference over the length of the apparatus, whereby the air experiences only slight resistance in flow, while the melt is braked particularly well within the stair-shaped gap.

The individual steps of the stair-shaped gap preferably have a width that remains the same over the length of the apparatus, whereby the width of the inlet and/or outlet can be different from the width of the gap. For some application cases, it can also be practical if the width of one or more steps of the stair-shaped gap differs, in part, over the length of the apparatus, from other steps of the stair-shaped gap.

It has been found that a combination of materials, namely tungsten or a tungsten alloy for the first steps, preferably the first three steps, seen in the flow direction, and copper or a copper alloy for the subsequent steps, in the flow direction, yields an optimal result with regard to the wear resistance and heat dissipation of the apparatus.

Furthermore, it is generally known and does not require any further explanation that the gap must be closed off on both sides, over the length of the apparatus. For this purpose, the apparatus can advantageously have a collar on both sides, which allows corresponding sealing of the gap in the lateral direction. The two mold halves lie directly on top of one another, without a gap, in the region of the collar that is present on both sides.

Of course, the apparatus can also have further structural elements, for example guide elements for alignment of the two mold halves relative to one another or accommodations for attachment and alignment of the apparatus within the casting mold.

It can be advantageous if the stair-shaped gap has at least six, preferably at least eight consecutive steps.

It can be advantageous if the stair-shaped gap has at most twelve, preferably at most eight consecutive steps.

It can be practical if the stair-shaped gap has at least one, preferably a single stair flight. In the present case, a stair flight is understood to be multiple consecutive steps that do not have any interruption, for example in the form of a stair landing.

However, it can also be advantageous if the stair-shaped gap has at least one stair landing, in other words a type of platform that interrupts the stair flight and divides the stair-shaped gap essentially into multiple smaller segments.

It can be advantageous if the stair-shaped gap has a stair incline having an incline angle of 10 to 35°, preferably of 15 to 20°, very preferably of 16 to 18°.

It can be practical if the stair-shaped gap has at least one riser that has a different height from another riser of the stair-shaped gap. The riser is essentially the vertical part of a step, viewed in the flow direction from the gap inlet.

In order to brake the melt flow as strongly as possible, it is advantageous if at least one riser that is in the front in the flow direction, preferably the first riser of the stair-shaped gap, has a greater height than a subsequent riser, in the flow direction, of the stair-shaped gap.

It can be advantageous if the height of the first riser, in the flow direction, of the stair-shaped gap amounts to between 5 and 20 mm, preferably between 5 and 10 mm, very preferably between 7 and 9 mm.

It can be advantageous if the height of the subsequent risers, following the first riser, in the flow direction, of the stair-shaped gap, amounts to between 1 and 10 mm, preferably between 2 and 7 mm, very preferably between 3 and 6 mm.

It can be advantageous if the length of the treads of the stair-shaped gap amounts to between 5 and 20 mm, preferably between 10 and 18 mm, very preferably between 12 and 15 mm. The tread is essentially the horizontal part of a step, viewed in the longitudinal direction from the gap inlet.

It can be practical if the running length of the stair-shaped gap, measured as a straight line between the front edge of the first step, seen in the flow direction, and the front edge of the last step, seen in the flow direction, amounts to between 50 and 300 mm, preferably 70 and 200 mm, very particularly between 90 and 150 mm.

It can be advantageous if the apparatus is disposed in a slide of the casting mold, at least with one mold half, in such a manner that this mold half separates from the opposite mold half when the slide is pulled.

It can be practical if the apparatus is provided with one mold half in the fixed casting mold element and with the other mold half in the movable casting mold element.

It can be advantageous if the one mold half of the apparatus is disposed countersunk into the fixed casting mold element and if the other mold half of the apparatus is disposed projecting out of the movable casting mold element.

It can be advantageous if the casting mold is a pressure-casting mold.

It can be advantageous if the stair-shaped gap that forms between the steps of one mold half and the steps of the second mold half has a uniform or a changing gap dimension over the length of the apparatus.

BRIEF DESCRIPTION OF THE DRAWINGS

Further details and advantageous embodiments of the invention are evident from the following description of exemplary embodiments in connection with the drawings. This shows.

DETAILED DESCRIPTION OF THE PREFERRED EMBODIMENTS

Figure 1:
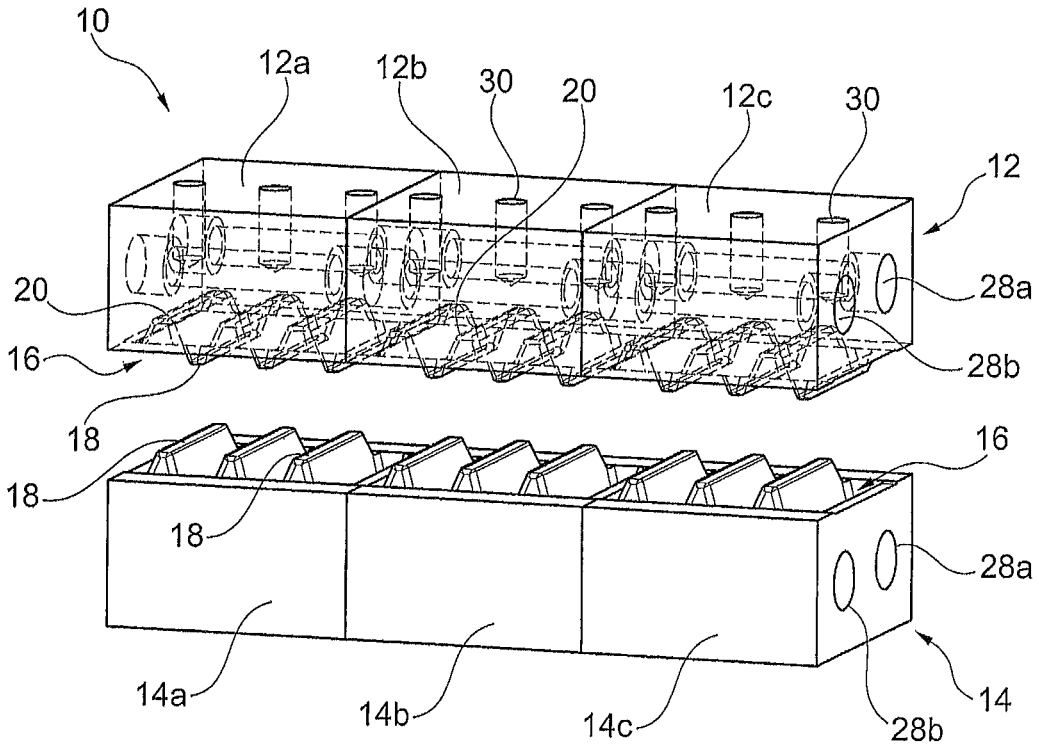
FIG. 1 in a schematic, perspective view, an upper and a lower mold half of a first apparatus according to the invention, composed of three segments, in each instance, whereby the upper mold half is shown to be transparent, FIG. 2 in a schematic representation in longitudinal section, two mold halves of a second apparatus according to the invention, set on top of one another, FIG. 3 in a schematic representation in longitudinal section, two mold halves of a third apparatus according to the invention, set on top of one another, FIG. 4 in a schematic, perspective representation, an upper and a lower mold half of the first apparatus according to the invention, FIG. 5 in a schematic, perspective representation, a segment of the lower mold half of the first apparatus according to the invention, FIG. 6 in a schematic representation, a first mold half of the apparatus according to the invention, recessed into a fixed casting mold element, FIG. 7 in a schematic representation, a second mold half of the apparatus according to the invention, projecting out of a movable casting mold element, particularly out of a slide provided separately in the movable casting mold element, and FIG. 8 in a schematic representation in longitudinal section, two mold halves of the apparatus according to the invention, set on top of one another.

When the same reference numbers are used in FIGS. 1 to 8, they also refer to the same parts or regions.

As shown in FIGS. 1 to 4, the invention relates to an apparatus 10 for ventilation of a casting mold, particularly in the form of a chill vent, having two mold halves 12, 14 that lie opposite one another and are complementary, in terms of shape and function, to one another, which halves have a plurality of elevations 18 and/or depressions 20, in each instance, which run essentially parallel to one another and essentially transverse to the flow direction, on their surfaces 16 that face one another, in such a manner that when the mold halves 12, 14 are set onto one another, a gap 22 having an inlet 24 and an outlet 26 forms between the mold halves 12, 14, at least in part, which gap can particularly be washboard-shaped, labyrinth-shaped and/or meander-shaped, and through which gap air displaced out of the casting mold and excess molten material can flow during filling of the casting mold, whereby at least one or preferably each mold half 12, 14 is formed by multiple segments 12*a*, 12*b*, 12*c*, 14*a*, 14*b*, 14*c* disposed next to one another in the longitudinal direction of the mold half 12, 14 and releasably attached, preferably connected with one another.

For attaching them, the segments 12*a*, 12*b*, 12*c*, 14*a*, 14*b*, 14*c* of the mold half 12, 14, disposed next to one another, have at least one bore 28*a*, 28*b*, 30, in each instance, for accommodating a fastening means.

Figure 2:
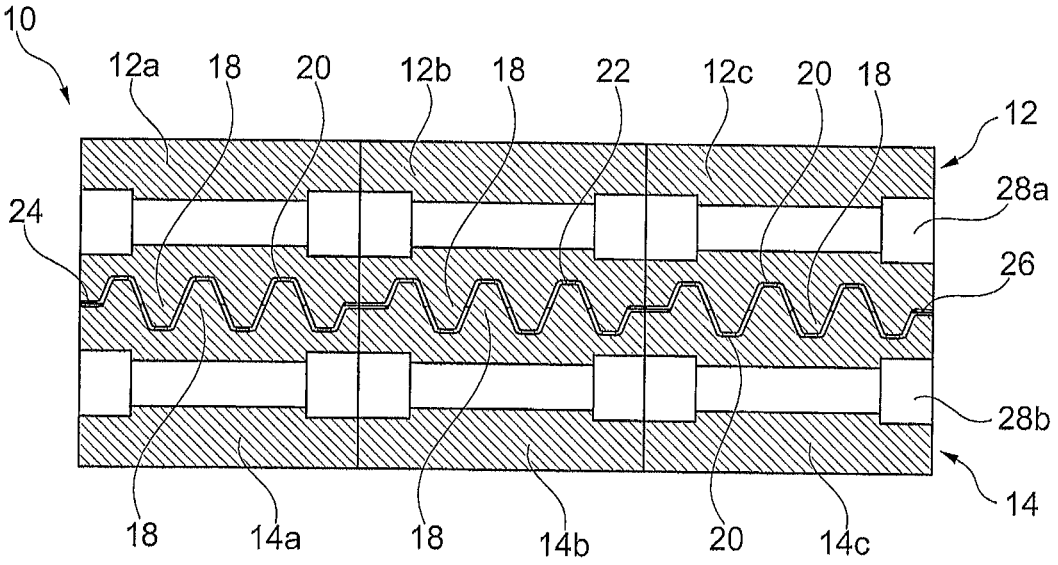
Figure 4:
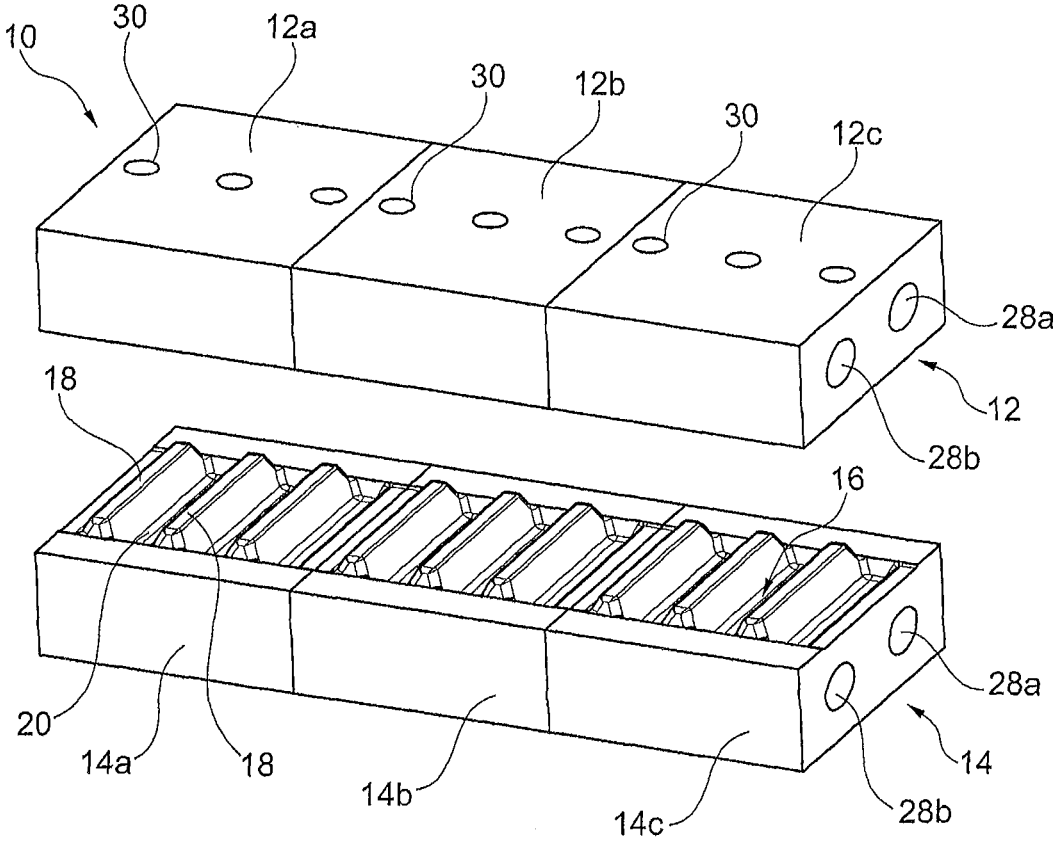
Figure 5:
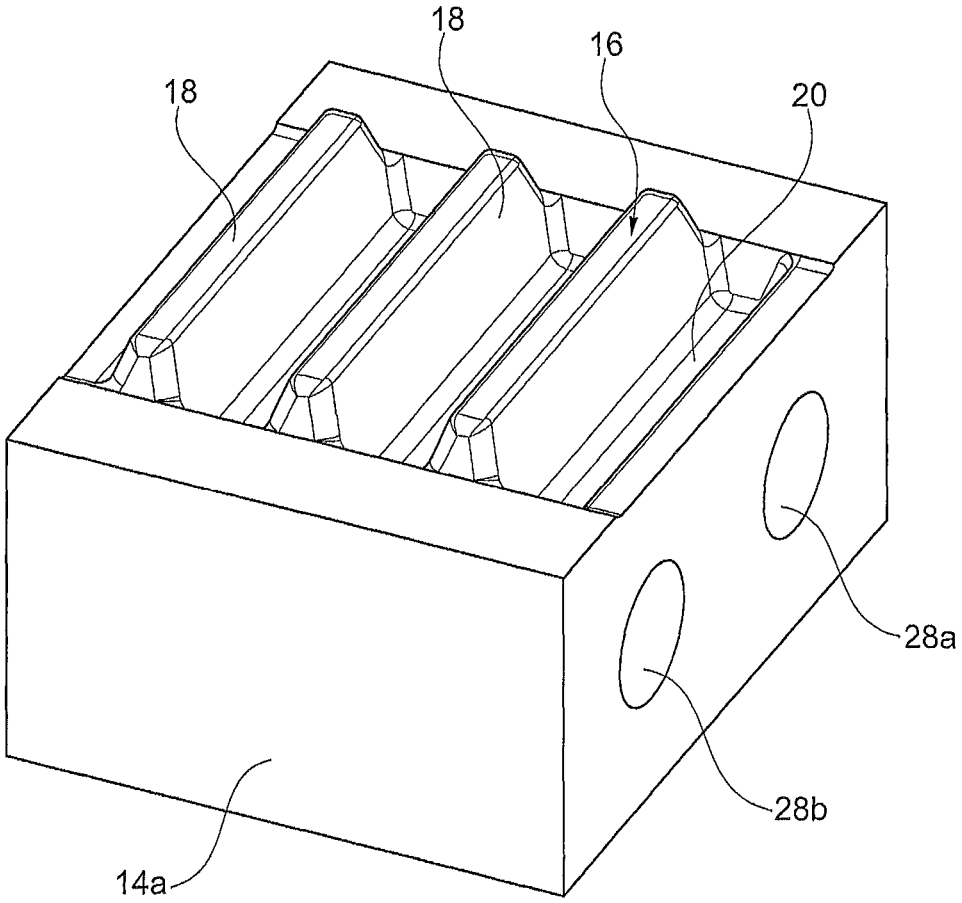

As shown in FIGS. 1, 2, 4, and 5, at least one, preferably two bores 28*a*, 28*b* that are spaced apart from one another and continuous in the longitudinal direction are provided per segment 12*a*, 12*b*, 12*c*, 14*a*, 14*b*, 14*c*, whereby each bore 28*a*, 28*b* that is continuous in the longitudinal direction, according to FIGS. 1, 2, and 4, aligns with a bore 28*a*, 28*b* of a segment 12*a*, 12*b*, 12*c*, 14*a*, 14*b*, 14*c* disposed adjacent to it, in such a manner that the segments 12*a*, 12*b*, 12*c*, 14*a*, 14*b*, 14*c* can be connected with one another, particularly screwed together, by attachment means, not shown here, passed through the aligned bores 28*a*, 28*b*. It is advantageous that the screw connection can also serve for attachment in the casting mold or in or on a casting mold element.

Figure 3:
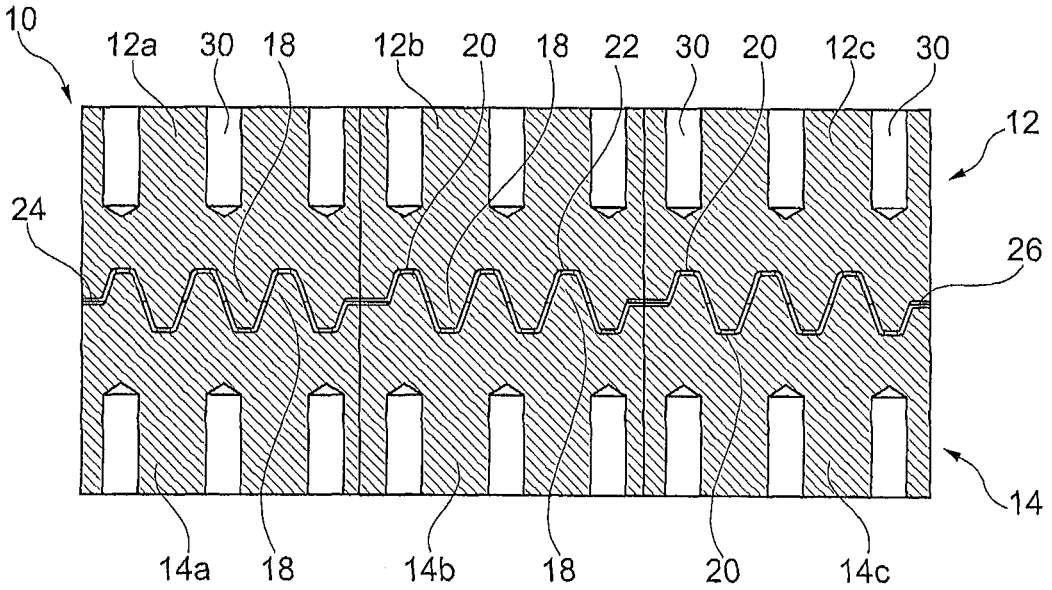

As is particularly shown in FIG. 3, at least one, preferably multiple bores 30 for attachment means, which are spaced apart from one another and introduced from the outside, on one side, in the transverse direction, are provided per segment 12*a*, 12*b*, 12*c*, 14*a*, 14*b*, 14*c*, by means of which each segment 12*a*, 12*b*, 12*c*, 14*a*, 14*b*, 14*c* can be connected with a base body, not shown here, particularly the casting mold or an insert for it, particularly screwed onto it, preferably in such a manner that the segments 12*a*, 12*b*, 12*c*, 14*a*, 14*b*, 14*c* are releasably disposed next to one another in the longitudinal direction of the mold half 12, 14. This can be done by itself or in addition to the bores 28*a*, 28*b* for attachment means in the longitudinal direction.

The segments 12*a*, 12*b*, 12*c*, 14*a*, 14*b*, 14*c* of the mold half 12, 14 can be releasably connected with one another with shape fit and/or force fit.

It is advantageous if the segments 12*a*, 12*b*, 12*c*, 14*a*, 14*b*, 14*c* of a mold half 12, 14 consist of the same, most cost-advantageous material possible, preferably of steel, so that when wear occurs, the corresponding segment merely has to be replaced.

Of course, it is also possible that at least two segments 12*a*, 12*b*, 12*c*, 14*a*, 14*b*, 14*c* of a mold half 12, 14 consist of a different material, preferably of steel, copper, tungsten or a molybdenum alloy. In this way, it is also possible to use more wear-resistant materials, if this is indicated.

It is particularly practical if at least two segments 12*a*, 12*b*, 12*c*, 14*a*, 14*b*, 14*c* of the mold half 12, 14 are configured with an identical shape, as a result of which cost-advantageous replaceability exists and, for this purpose, no large variety of segments must be kept on hand. This also saves production and storage costs.

It has been shown that the bores 28*a*, 28*b* that align with one another can be used particularly well as a coolant line, particularly for air or water.

The apparatus 10 according to the invention, for ventilation of a casting mold, can comprise, as a further development but also independently, two mold halves 12, 14 that lie opposite one another and are complementary, in terms of shape and function, to one another, which halves have a plurality of steps 36, in each instance, which run essentially parallel to one another and essentially transverse to the flow direction, on their surfaces that face one another.

Figure 6:
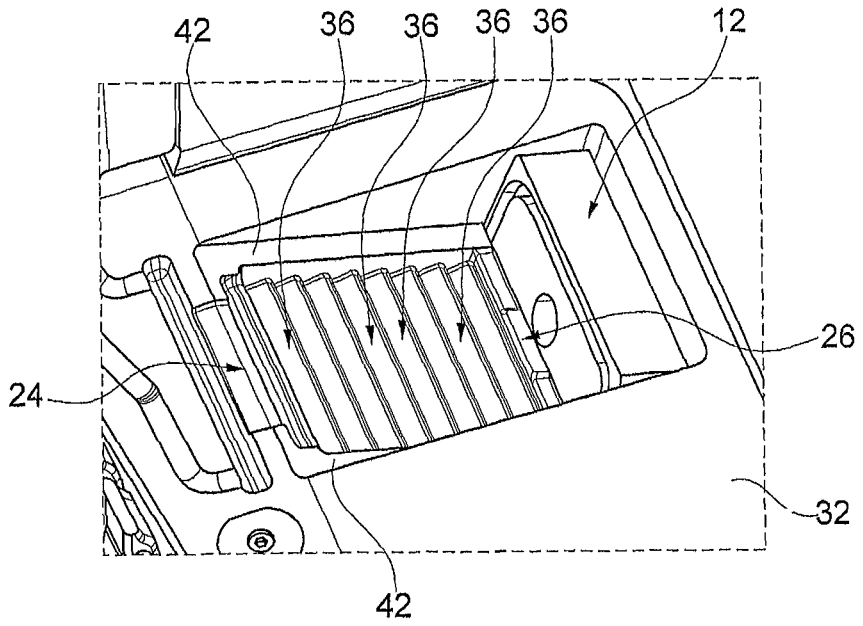

The one mold half 12 of the apparatus 10 is disposed—as shown in FIG. 6—countersunk in a fixed casting mold element 32. The other mold half 14 of the apparatus 10 is disposed—as shown in FIG. 2—in a movable casting mold element 34, specifically emerging or projecting from it. Preferably, this mold half 14 last mentioned is part of a slide. The casting mold is preferably a die-casting mold.

Figure 8:
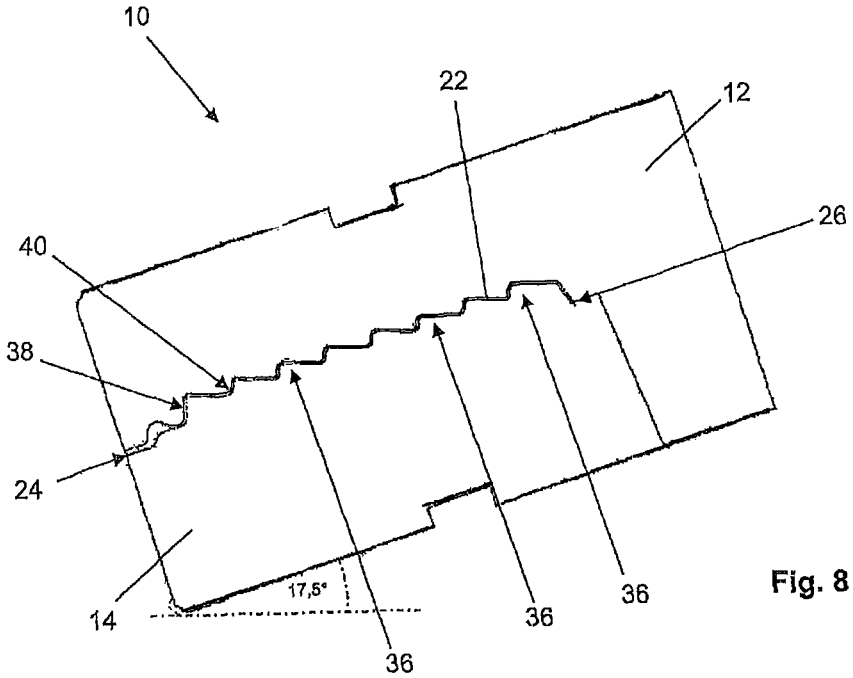

In the case of mold halves 12, 14 set onto one another—as shown in FIG. 8—the steps 16 of the one mold half 12 form a stair-shaped gap 22, having an inlet 24 and an outlet 26, with the steps 16 of the second mold half 14, through which gap air displaced from the casting mold and excess molten material can flow during filling of the casting mold.

The stair-shaped gap 22 has eight steps 36 that follow one another in a single stair flight.

The stair-shaped gap 22 has a stair incline having an incline angle of 17.5° in the present embodiment.

According to the invention, the first riser 38 of the stair-shaped gap 22, in the flow direction, has a greater height than the subsequent riser 40 of the stair-shaped gap 22, in the flow direction.

Figure 7:
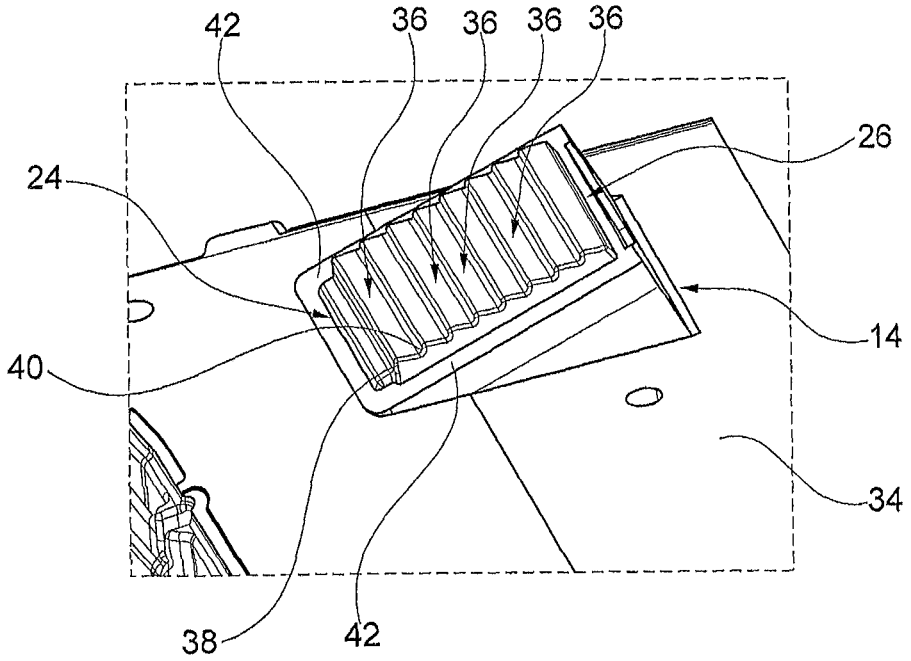

In FIGS. 6 and 7, it can be clearly seen that the gap 22 can be sealed on both sides, over the length of the apparatus 10. For this purpose, the apparatus 10 has a collar 42 on both sides, which allows corresponding sealing of the gap in the lateral direction, whereby the two mold halves 12, 14 lie directly on top of one another, without a gap, in the region of the collar 42 that is present on both sides.

The invention claimed is:

1. An apparatus for ventilation of a casting mold, the apparatus being in the form of a chill vent, having two mold halves that lie opposite one another and are complementary, in terms of shape and function, to one another, which halves have a plurality of elevations and/or depressions, in each instance, which run essentially parallel to one another and essentially transverse to a flow direction, on their surfaces that face one another, in such a manner that when the mold halves are set onto one another, a gap having an inlet and an outlet forms between the mold halves, at least in part, which gap is washboard-shaped, labyrinth-shaped and/or meander-shaped, and through which gap air displaced out of the casting mold and excess molten material flow during filling of the casting mold, wherein at least one mold half is formed by multiple segments disposed next to one another only in the longitudinal direction of the mold half, releasably attached, and having a same height in the transverse direction, wherein at least two bores that are spaced apart from one another and continuous in the longitudinal direction are provided per segment, and wherein each bore that is continuous in the longitudinal direction aligns with a bore of a segment disposed adjacent to it, in such a manner that the segments are connected with one another via an attachment element passed through the aligned bores.

2. The apparatus for ventilation of a casting mold, according to claim 1, wherein the at least two bores are introduced from the outside, on one side, in the transverse direction, and wherein via the at least two bores each segment is connected with a base body in such a manner that the segments are releasably disposed next to one another in the longitudinal direction of the mold half.

3. The apparatus for ventilation of a casting mold, according to claim 1, wherein the segments of the mold half are releasably connected with one another with shape fit and/or force fit.

4. The apparatus for ventilation of a casting mold, according to claim 1, wherein the segments of a mold half consist of the same material.

5. The apparatus for ventilation of a casting mold, according to claim 1, wherein the segments of a mold half consist of a different material.

6. The apparatus for ventilation of a casting mold, according to claim 1, wherein the bores that align with one another are used as a coolant line.

7. The apparatus for ventilation of a casting mold, according to claim 1, wherein the two mold halves that lie opposite one another and are complementary, in terms of shape and function, to one another, have a plurality of steps, in each instance, which run essentially parallel to one another and essentially transverse to the flow direction, on their surfaces that face one another, in such a manner that when the mold halves are set onto one another, the steps of one mold half form a stair-shaped gap having an inlet and an outlet with the steps of the second mold half, through which gap air displaced out of the casting mold and excess molten material flow during filling of the casting mold.

8. An apparatus for ventilation of a casting mold, the apparatus being in the form of a chill vent, having two mold halves that lie opposite one another and are complementary, in terms of shape and function, to one another, which halves have a plurality of elevations and/or depressions, in each instance, which run essentially parallel to one another and essentially transverse to a flow direction, on their surfaces that face one another, in such a manner that when the mold halves are set onto one another, a gap having an inlet and an outlet forms between the mold halves, at least in part, which gap is washboard-shaped, labyrinth-shaped and/or meander-shaped, and through which gap air displaced out of the casting mold and excess molten material flow during filling of the casting mold, wherein at least one mold half is formed by multiple segments disposed next to one another in the longitudinal direction of the mold half and releasably attached, and wherein at least two segments of the mold half are configured with an identical shape and an identical size.

* * * * *